United States Patent [19]

Hara et al.

[11] Patent Number: 4,503,818

[45] Date of Patent: Mar. 12, 1985

[54] VARIABLE VALVE TIMING ARRANGEMENT FOR AN INTERNAL COMBUSTION ENGINE OR THE LIKE

[75] Inventors: Seinosuke Hara, Yokosuka; Kazuyuki Miisho, Yokohama, both of Japan

[73] Assignee: Nissan Motor Company, Limited, Japan

[21] Appl. No.: 375,472

[22] Filed: May 5, 1982

[30] Foreign Application Priority Data

May 18, 1981 [JP] Japan ..... 56-74582

[51] Int. Cl.[3] ..... F01L 1/10

[52] U.S. Cl. ..... 123/90.16; 123/90.44; 123/90.17

[58] Field of Search ..... 123/90.12, 90.17, 90.15, 123/90.31, 90.39, 90.41, 90.44, 90.16, 90.45, 90.47, 90.27, 198 P

[56] References Cited

U.S. PATENT DOCUMENTS

| | | | |
|---|---|---|---|
| 777,295 | 12/1904 | Marx | 123/90.16 |
| 1,691,991 | 11/1928 | Puckett | 123/90.44 |
| 1,710,291 | 12/1926 | Brush | 123/90.43 |
| 2,997,991 | 8/1961 | Roan | 123/90.16 |
| 3,413,965 | 12/1968 | Gavasso | 123/90 |
| 3,470,857 | 10/1969 | Stivender | 123/90.43 |
| 3,641,988 | 2/1972 | Torazza et al. | 123/90.27 |
| 3,913,548 | 10/1975 | Wilson | 123/90.16 |
| 4,138,973 | 2/1979 | Luria | 123/90.16 |

FOREIGN PATENT DOCUMENTS

| | | | |
|---|---|---|---|
| 209739 | 3/1908 | Fed. Rep. of Germany . | |
| 2335634 | 1/1975 | Fed. Rep. of Germany | 123/90.16 |

*Primary Examiner*—Ira S. Lazarus
*Assistant Examiner*—R. S. Bailey
*Attorney, Agent, or Firm*—Lowe, King, Price & Becker

[57] ABSTRACT

The present invention features a valve train for inducing reciprocative motion in a valve which includes a lever pivotally mounted at one end thereof, a rocker arm which engages the lever to define a fulcrum point therebetween, and which engages a valve at one end thereof, a first cam which engages the other end of the rocker arm, a second cam which engages the top of the lever and a mechanism which guidingly interconnects the rocker arm, at a point intermediate of the ends thereof, with the lever for preventing relative slip therebetween and for ensuring that a cam following portion of the rocker arm smoothly follows the first cam.

14 Claims, 27 Drawing Figures

FIG.9
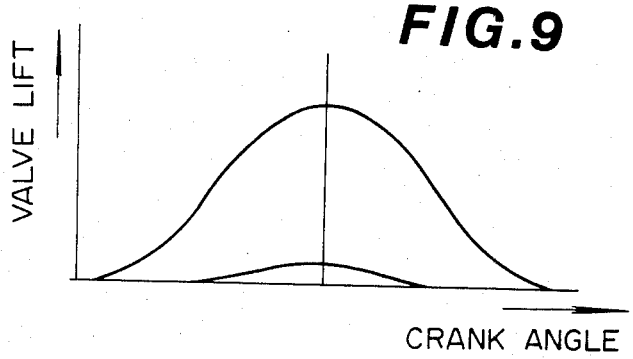
FIG.10A
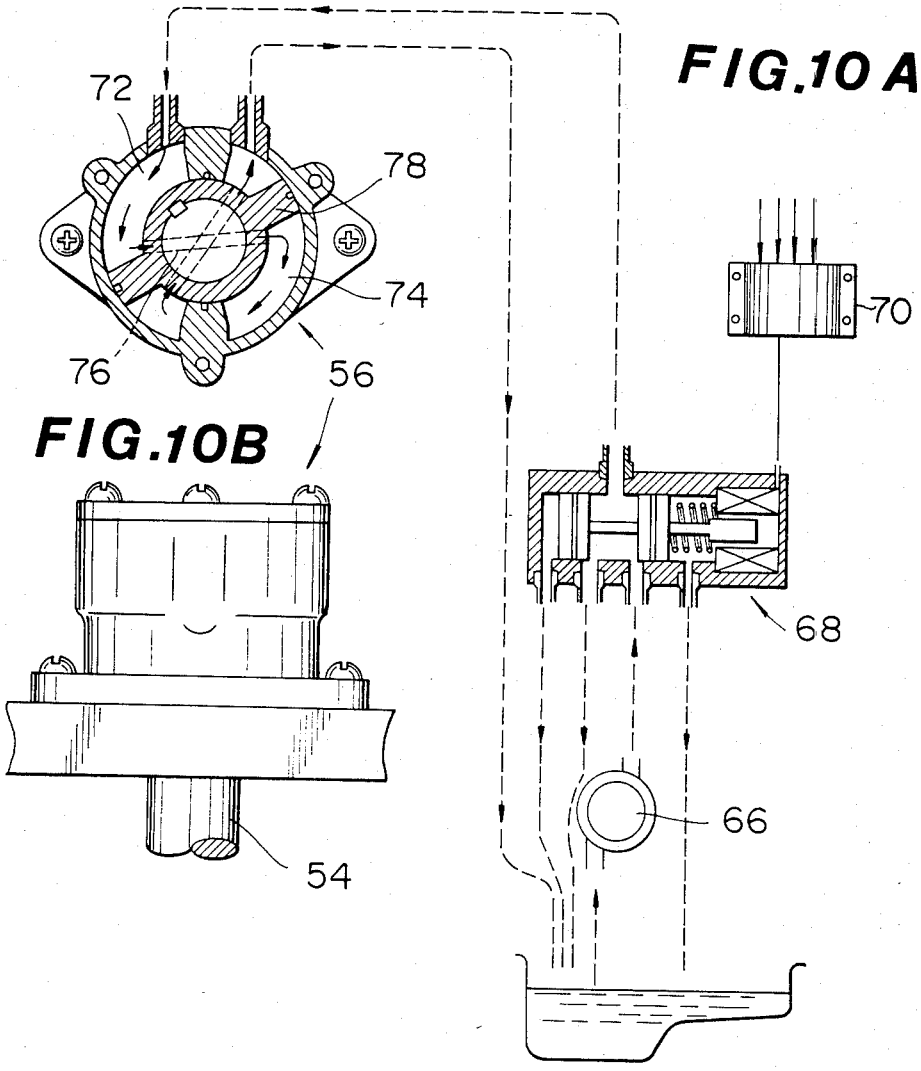
FIG.10B

VARIABLE VALVE TIMING ARRANGEMENT FOR AN INTERNAL COMBUSTION ENGINE OR THE LIKE

BACKGROUND OF THE INVENTION

1. Field of the Invention

The present invention relates generally to a valve train for an internal combustion engine or the like and more specifically to a variable valve timing arrangement therefor.

2. Description of the Prior Art

In a known arrangement such as shown in FIGS. 1 and 2 of the present application, it has been proposed to operate a poppet valve, such as an inlet or exhaust valve of an internal combustion engine, via a rocker arm 1 which engages a cam 2 at one end and which is pivotally mounted on top of the stem 3 of the valve 4 at the other end. The upper surface of the rocket arm 1 is contoured and adapted to abut a lever 5. The point of abutment with the lever 5 defines the pivot or fulcrum point of the rocker arm. With this arrangement, as the cam 2 rotates, the rocker arm 1 is cammed to pivot about the fulcrum point defined by the aformentioned contact and induce the valve 4 to reciprocate. To vary the timing and degree of lift of the valve 4, a second cam 6 is provided and adapted to abut the lever 5. The second cam 6 is selectively rotated by a suitable motor or actuator or the like (not shown). Thus, if the second cam 6 is rotated in a direction to urge the lever 5 to rotate counter-clockwise (viz., downwardly as seen in the drawings) the degree of valve lift and the duration that the valve is open will be increased. Rotation of the cam which allows the lever to pivot in the clockwise direction (as seen in the drawings) reduces the valve lift and the duration for which the valve is open.

However, this arrangement has suffered from a number of drawbacks. That is to say, as the cam rotates a thrust acting in the longitudinal direction of the rocker arm tends to be imparted to the same and as the rocker arm is pivotally mounted on top of the valve stem, the valve stem is subject to a moment which tends to bend it. To compensate for this bending phenomenon, either the diameter of the valve stem has to be increased or a tappet 7 such as shown in FIG. 2 has to be installed. Both of these countermeasures tend to undesirably increase the mass and thus the inertia of the moving elements and in the case wherein the tappet 7 is provided, the moment which would otherwise tend to bend the valve stem tends to bias the tappet sideways against the wall of the cylinder in which it is disposed, inducing friction loss and rapid wear. Moreover, the surfaces of the rocker arm and the lever between which the fulcrum point is defined, tend to exhibit a high relative sliding velocity which induces rapid wear therebetween.

Yet another major drawback is encountered by this prior art arrangement. The drawback arises in that the return stroke of the rocker arm (viz., as the poppet valve closes) must be induced exclusively by the valve spring (or springs), as it is not possible to install a suitable spring for this purpose between the rocker arm and the lever due to the prohibitively complex relative motion therebetween. Thus, when the lever is allowed to rotate in the clockwise direction (to reduce valve lift) the fulcrum point defined between the lever and the rocker arm tends to move in the direction of the pivot point of the rocker arm 1 reducing the moment biasing the rocker arm into contact with the cam 2. Accordingly, the rocker arm 1 is not held on the cam with sufficient force and tends to bounce on the cam rather than smoothly following, same leading to the generation of noise, vibration and undesirable wear. This problem is further enhanced by the need to provide a suitable clearance between the valve stem and rocker arm to allow for thermal expansion etc.

For a complete disclosure of the arrangement described above, reference may be made to U.S. Pat. No. 3,413,965 which issued on Dec. 3, 1969 in the name of J. M. Gavasso.

SUMMARY OF THE INVENTION

The present invention features a pivotal lever and a rocker arm which is mechanically connected thereto to prevent relative slip between the rocker arm and the lever as the rocker arm rolls along the lever and to ensure that the rocker arm smoothly follows the cam which operates the same.

More specifically the invention takes the form of a lever which is pivotally mounted at one end thereof, a rocker arm which engages said lever to define a fulcrum point therebetween and which engages said valve at one end thereof, a mechanism which guidingly interconnectes said rocker arm at a point intermediate of the ends thereof with said lever, first means which engages one of said lever and the other end of said rocker arm for inducing reciprocative motion therein, and second means which engages the other of said lever and said other end of said rocker arm for selectively controlling the angular position thereof with respect to said valve.

BRIEF DESCRIPTION OF THE DRAWINGS

The features and advantages of the arrangement of the present invention will become more clearly appreciated from the following description taken in conjunction with the accompanying drawings in which

FIG. 9 is a graph showing the above mentioned maximum and minimum lifts and the corresponding durations for which the valves are open;

FIG. 10A is a schematic drawing showing an example of a hydraulic control circuit and actuator which may be utilized in combination with the various embodiments of the present invention;

FIG. 10B is a plan of the actuator shown in section in FIG. 10A;

DETAILED DESCRIPTION OF THE PREFERRED EMBODIMENTS

Figure 1:
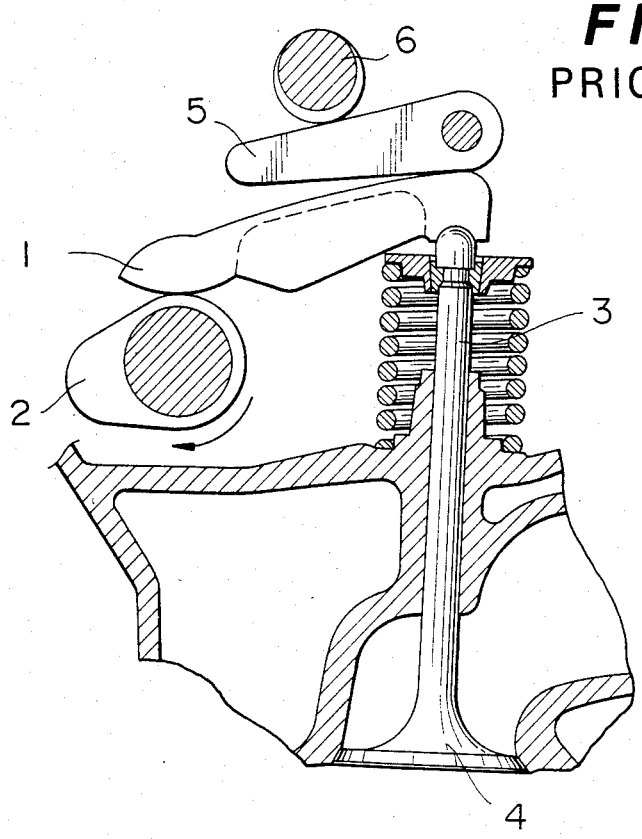
FIG.1 PRIOR ART
FIG. 1 is an elevation of the prior art arrangement discussed in the opening paragraphs of the instant application.
Figure 2:
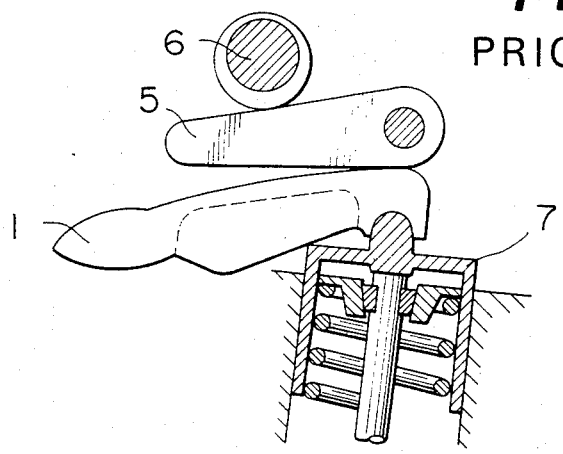
FIG.2 PRIOR ART
FIG. 2 is a sectional elevation showing the provision of the tappet as per the opening paragraphs of the instant application.
Figure 3:
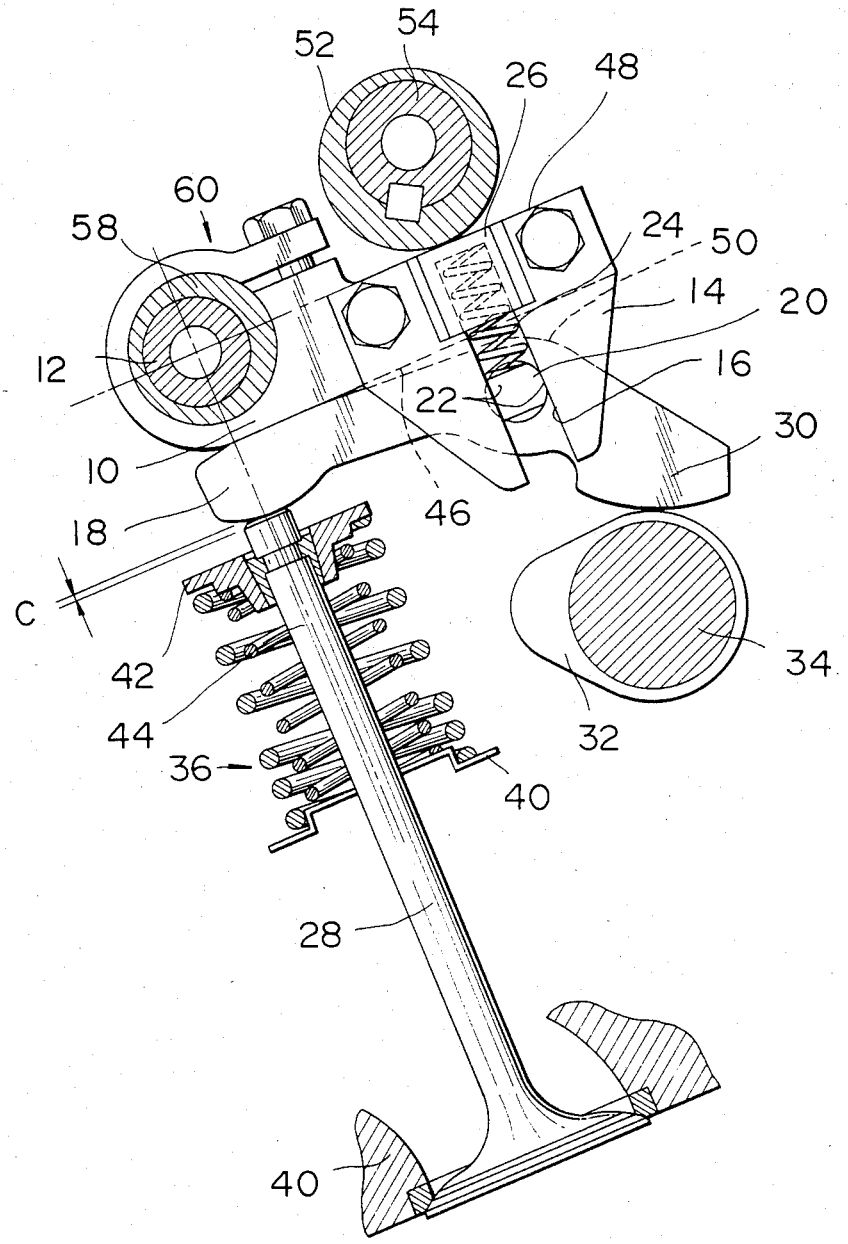
FIG. 3 is a partially sectioned elevation of a first embodiment of the present invention.
Figure 4:
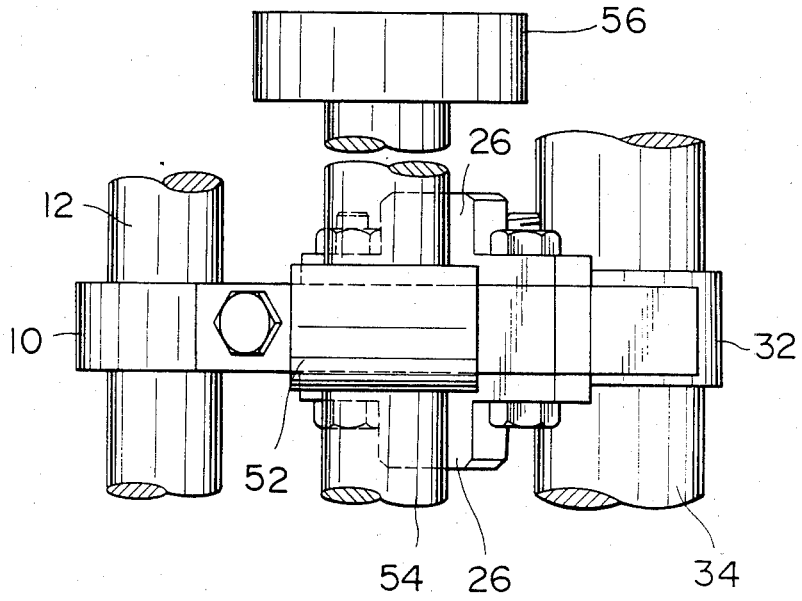
FIG. 4 is a plan view of the arrangement shown in FIG. 3.

Turning now to the drawings and in particular to FIGS. 3 and 4, a first embodiment of the present invention is shown in conjunction with an internal combustion engine. In this arrangement a lever 10 is pivotally mounted at one end thereof on a stationary shaft 12 and provided on either side thereof with a pair of guide forks 14 formed with guide slots 16.

A "bell crank lever-like" rocker arm 18 has a shaft 20 rotatably disposed through same at a location intermediate of the ends thereof. The ends of the shaft 20 which project out from either side of the rocker arm 18 are provided with flats 22 and are received in the guide slots so that the flats slide on the opposed walls thereof. A pair of springs 24 are disposed between retainers 26 formed in the upper portions of the guide forks and the ends of the rotatable shaft 20. One end of the rocker arm is adapted to abut the top of the stem of a poppet valve 28 (which may be either an inlet or an exhaust valve) while the other end is provided with a cam follower portion 30 which rides on a cam 32 mounted on an overhead cam shaft 34. The valve 28 is biased toward a closed position by a set of nested coil springs 36 interposed between the cylinder head 40 of the engine and a spring retainer 42 disposed adjacent the top of the valve stem 44. The nested springs 36 are stronger than the springs 24 which serve to maintain the cam follower portion 30 of the rocker arm 18 in continous contact with the cam 32.

The lever 10 is formed with two essentially flat surfaces (46,48) one of which is on the lower side of the lever (as seen in the drawings) while the other is on the upper side. As shown, the extrapolation of the flat surface 48, on the upper side in this instance, passes through the axis of rotation of the lever 10 which is also intersected by the axis of the valve stem 44.

The upper surface 50 of the rocker arm 18 in contact with the lever 10 is gently contoured so as to define a line contact therebetween. This line contact serves a fulcrum point of the rocker arm during operation of the valve train. A second cam 52 is mounted on a rotatable shaft 54 and arranged to abut the upper flat surface 48 of the lever 10. The shaft 54 is connected to a suitable hydraulic actuator 56 shown in FIG. 4 which controls the angular position of the second cam 52 with respect to the axis of rotation of the lever. It should also be noted that this cam and actuator arrangement may be replaced with other means such as an extensible cylinder or the like should it be deemed advantageous.

To permit adjustment of the clearance "C" between the top of the valve stem 44 and the rocker arm 18 the lever 10 is mounted on the shaft 12 through an eccentric bush 58. As shown the bush 58 is releasably clamped in place by a clamp 60 formed in the end of the lever.

Figure 6:
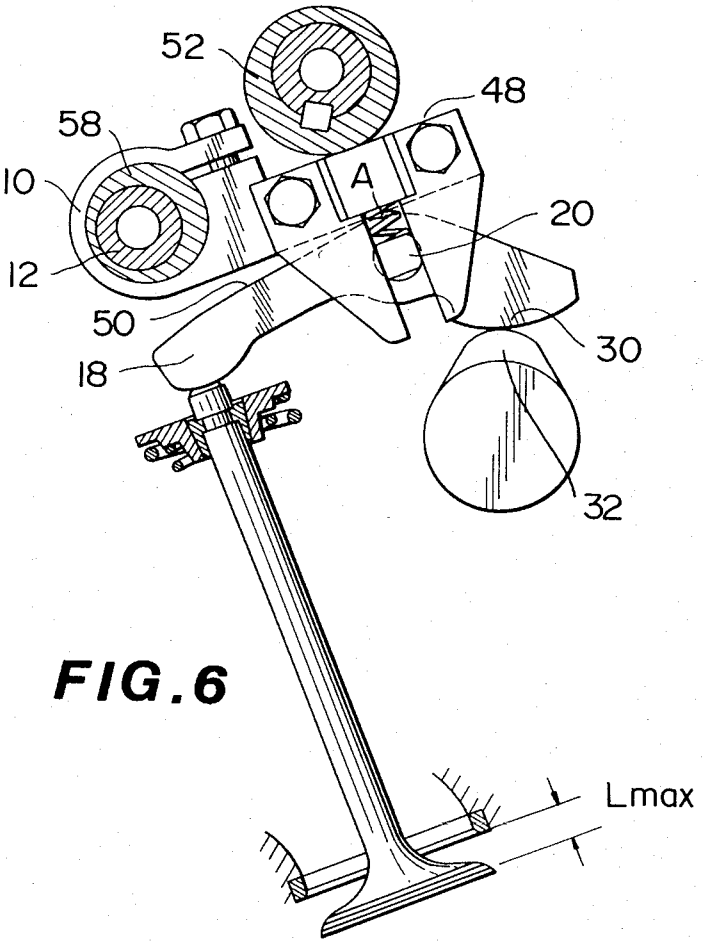
FIGS. 5 to 8 are partially sectioned elevations of the first embodiment of the present invention showing examples of the maximum and minimum valve lifts possible with the present invention.
Figure 5:
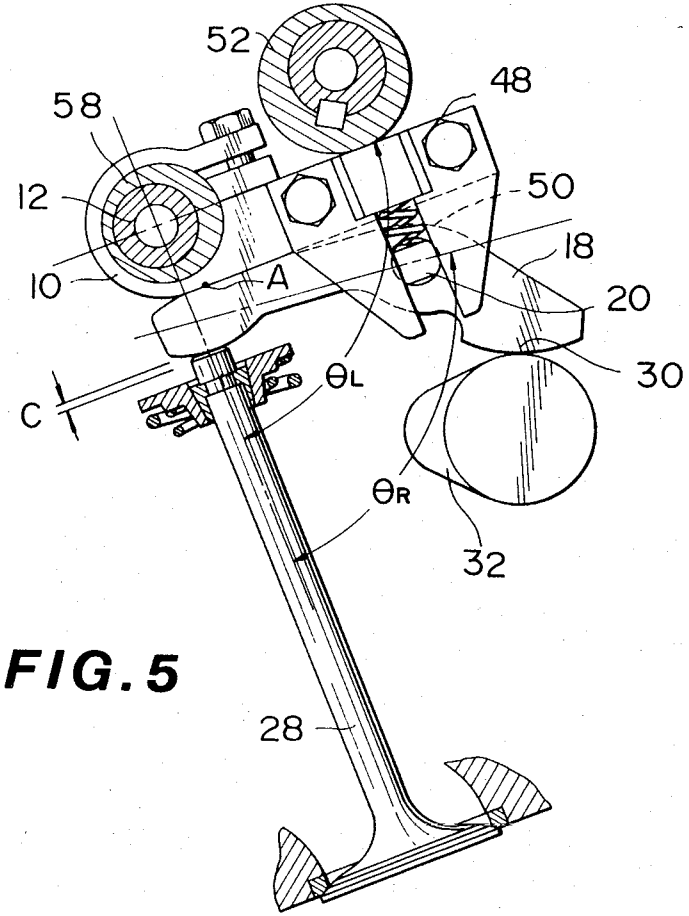
Figure 8:
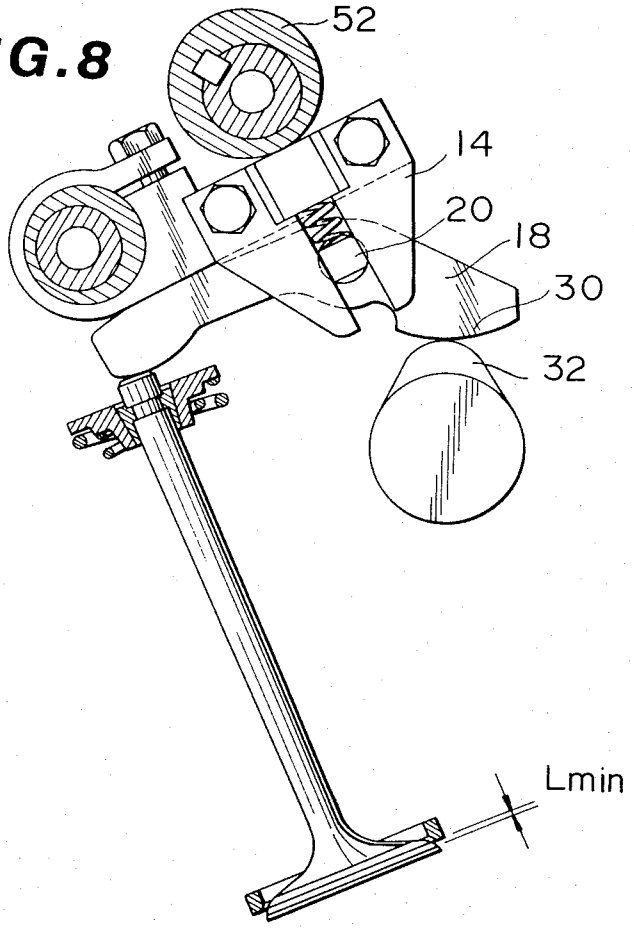
Figure 7:
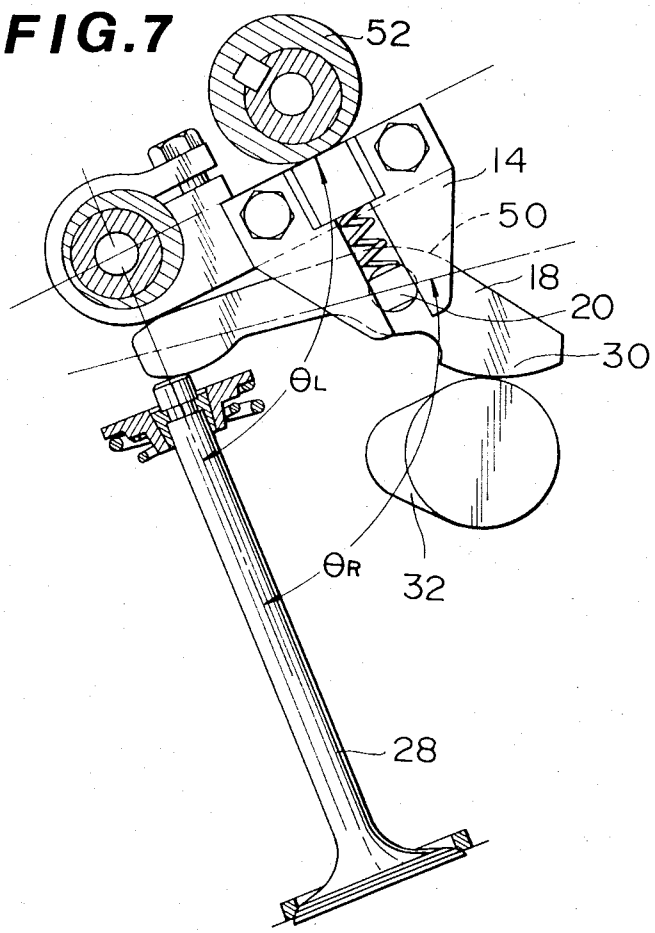

The operation of the above described apparatus will now be explained with reference to FIGS. 5 to 8, wherein FIGS. 5 and 6 show the cam in a position to induce the maximum valve lift (L max) and FIGS. 7 and 8 show the reverse case wherein the cam is set to induce the minimum valve lift (L min).

In FIGS. 5 and 6 the cam 52 is shown rotated to a position wherein a minimum angle ($\theta_L$) is defined between the axis of the valve stem 44 and the upper flat surface 48 of the lever 10. With the lever held in this position, as the cam 32 rotates to bring the lobe thereof into contact with the cam follower portion 30 of the rocker arm, the rocker arm 18 is biased upwardly, so as to compress the springs 24 slightly, and is induced to roll along the lower surface 46 of the lever so that the line contact ("A") defined between it and the lever moves from the position shown in FIG. 5 toward the position shown in FIG. 6. Due to the retaining action provided by the guide forks 14 the amount of relative slip which occurs between the lever and the rocker arm is minimized. Further, the curvature of the initial portion of the contoured surface 50 located near the end of the rocker arm is more gradual than the remainder so as to provide a "shock absorbing action" as the clearance "C" is reduced to zero and the valve 28 begins to open.

FIGS. 7 and 8 show the cam set in a position to induce the minimum lift (L min) and wherein the maximum angle ($\theta_L$) is defined between the upper flat surface 48 and the axis of the valve stem 44. As is apparent in FIG. 7, when the cam 52 is positioned to induce low valve lift, the angle defined between the rocker arm 18 and the lever 10 (that is, an angle defined between the upper flat surface 48 and a line taken through the midpoint of the end of the lever 10 and the center of the rotatable shaft 20) increases markedly as compared with the situation depicted in FIG. 5 (viz., $\theta_L$—$\theta_R$ increases as the valve lift decreases). With the cam 52 set in the position shown in FIG. 7, as the lobe of the cam 32 engages the cam follower portion 30 of the rocker arm, the rocker arm is biased upwardly against the bias of the springs 24 for a relatively long distance before the rocker arm 18 is induced to begin rolling along the lever. Thus as shown in FIG. 8, as the cam lobe reaches its peak lift position, the rocker arm 18 induces only a small valve lift. It should be noted however, that in fact it is possible to have a zero valve lift (viz., disable the valve) by appropriately increasing the angle defined between the upper flat surface and the axis of the valve stem a little more than that illustrated in FIG. 8.

FIG. 9 is a graph highlighting possible variations in valve lift and timing in terms of valve lift and crank angle achieved by the above disclosed embodiment.

FIG. 10A shows a hydraulic control circuit including the actuator 56 suitable for controlling the angular position of the cam 52. In this arrangement a pump 66 supplies hydraulic fluid under pressure to a solenoid controlled valve 68 which modulates the hydraulic pressure fed to a hydraulic actuator 56, which in this instance is of the vane type. The valve 68 is controlled by an energizing signal having a duty cycle variable in accordance with various parameters (such as engine speed, coolant temperature, vehicle speed, engine load etc.,) sensed by and computed in a suitable control circuit 70. The pressure discharged from the valve 68 is fed into a first chamber 72 of the actuator and thereafter transferred to a corresponding opposite chamber 74 via a transfer passage 76. The pressure in the chambers 72 and 74 tends to bias the vane 78 to rotate in the anticlockwise direction against the balancing force generated via the cam 52 engaging the lever 10. Thus, upon a predetermined pressure prevailing in the hydraulic chambers of the actuator 56 the shaft 54 will be rotated to induce the lever to rotate in the clockwise direction. Hence, to increase valve lift it is necessary to increase the pressure fed into the hydraulic chambers 72, 74 and vice versa.

Figure 11:
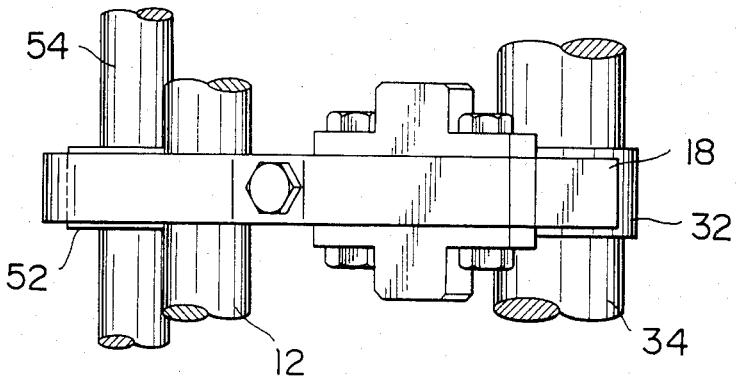
FIGS. 11 and 12 are respectively a plan and an elevation of a second embodiment of the present invention.
Figure 12:
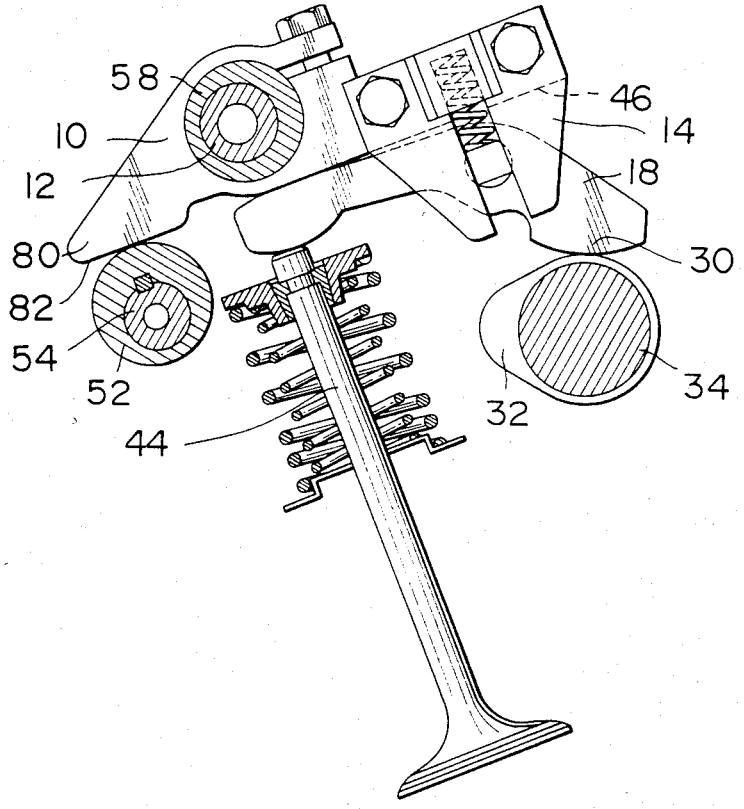

FIGS. 11 and 12 show a second embodiment of the present invention. In this embodiment the cam 52 is arranged in a lower position in the cylinder head adjacent the top of the valve stem 44. The lever 10 in this case is provided with a tang-like extension 80 on which a flat surface 82 for engagement with the cam 52 is formed. In this arrangement the flat surface 82 is essentially aligned with the flat surface 46 on which the rocker arm rolls. The operation of this embodiment is essentially the same as that of the first so that a detailed description thereof is omitted.

Figure 13:
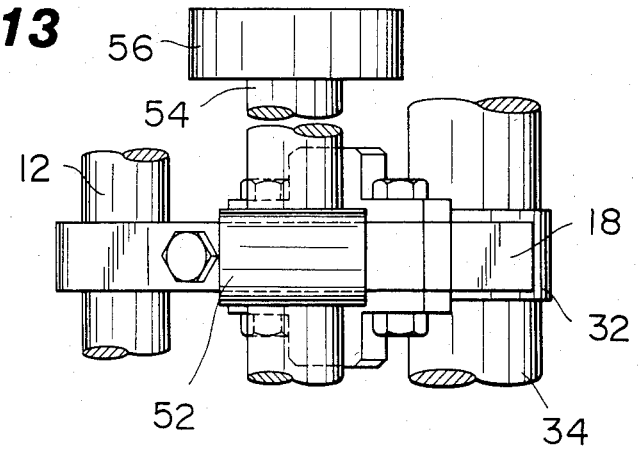
FIGS. 13 and 14 are respectively a plan and an elevation of a third embodiment of the present invention.
Figure 14:
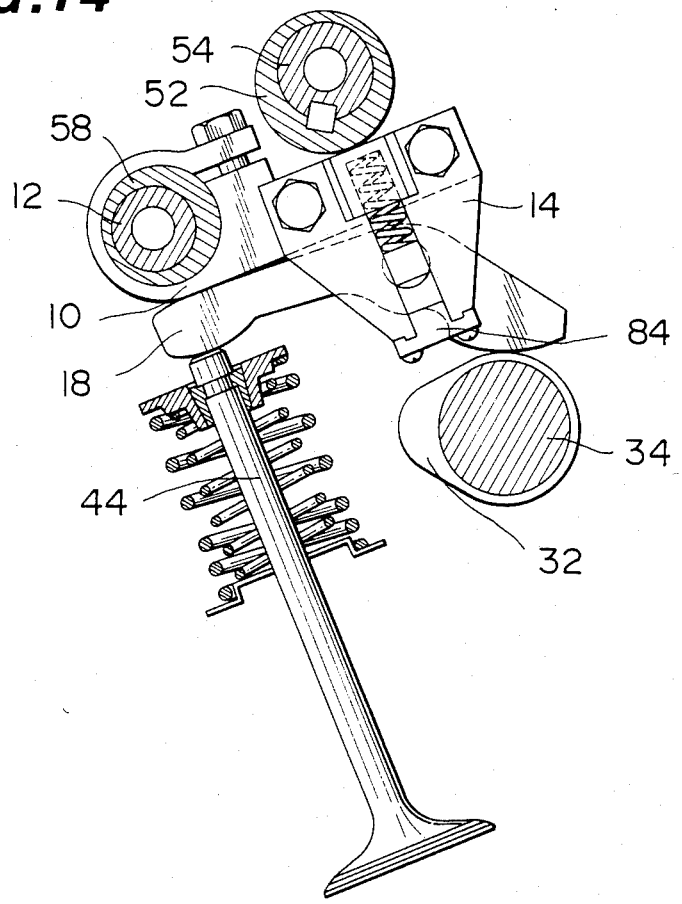

FIGS. 13 and 14 show a third embodiment of the present invention. This embodiment is similar to the first with the exception that a retainer 84 is secured to the bottom of each of the guide forks 14 for retaining the rotatable shaft 20 within the slots (which facilitates assembly) and which increases the rigidity of the forks per se.

Figure 15:
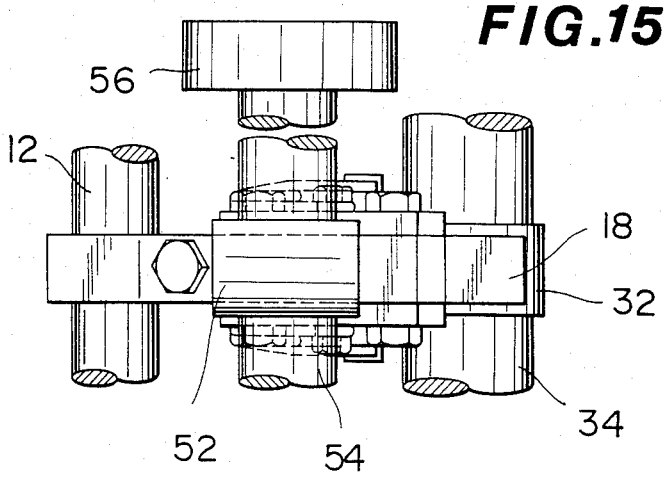
FIGS. 15 and 16 are respectively a plan and an elevation of a fourth embodiment of the present invention.
Figure 16:
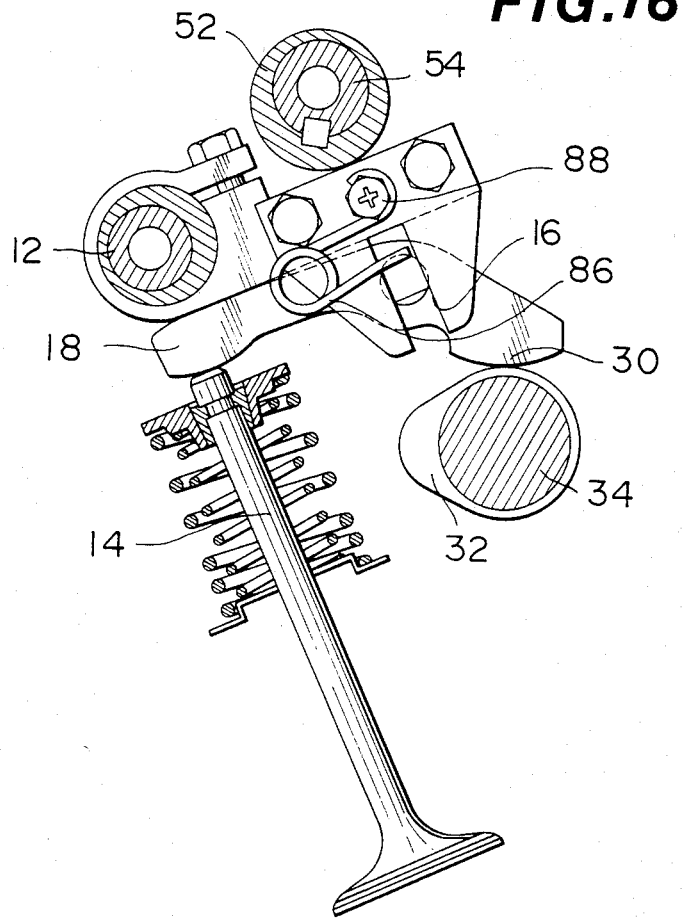

FIGS. 15 and 16 show a fourth embodiment of the present invention wherein the coil springs 24 are replaced with torsion springs 86. This arrangement allows for the springs to be secured in place by bolts 88 rather than through the use of spring retainers 26 as in the case of the previous embodiments.

Figure 17:
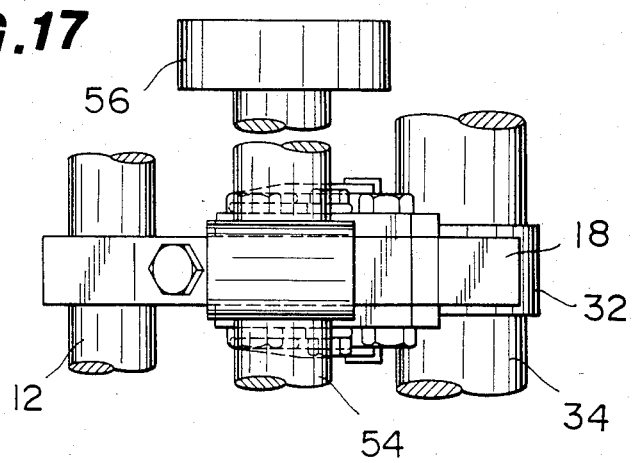
FIGS. 17 and 18 are respectively a plan and an elevation of a fifth embodiment of the present invention.
Figure 18:
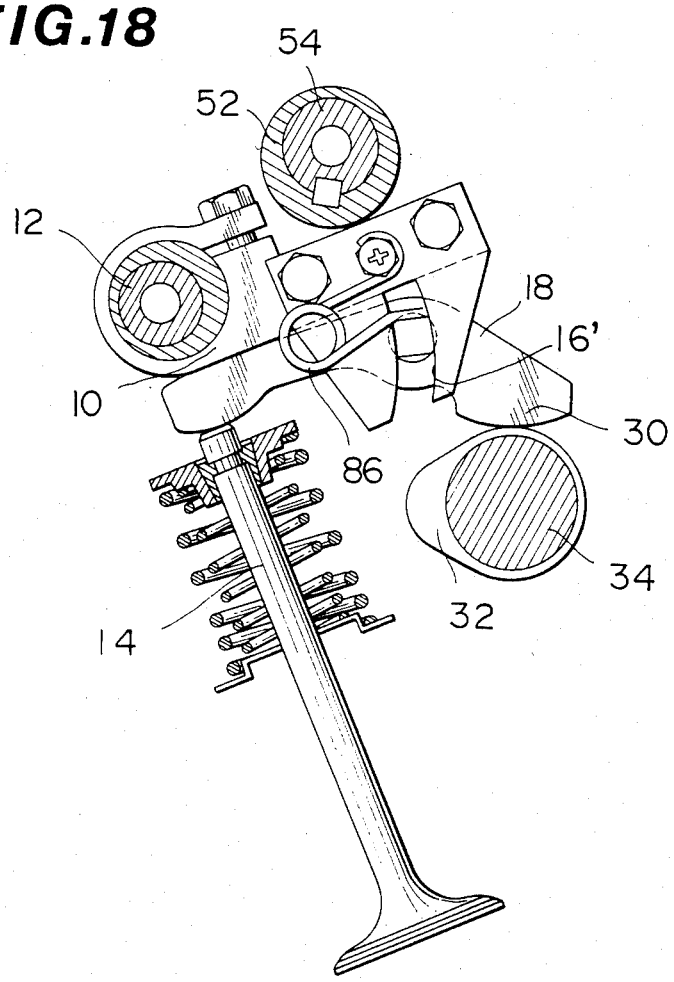

FIGS. 17 and 18 show a fifth embodiment of the present invention. This arrangement is essentially the same as the previous one with the exception that the guide slots 16' formed in the guide forks are curved. The curvature of the slots 16' suppresses any relative sliding between the rocker arm 18 and the lever 10 thus reduces wear therebetween.

Figure 19:
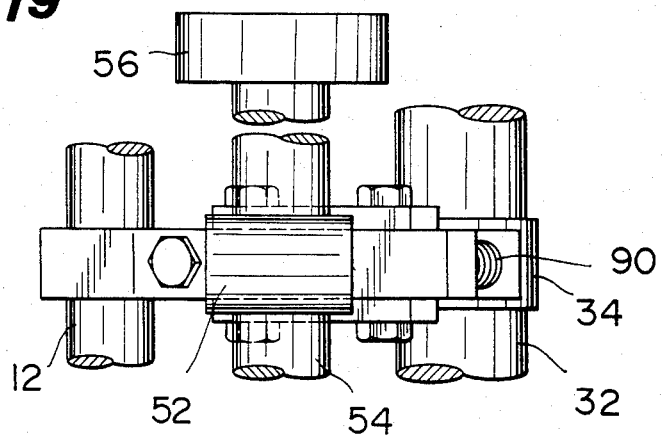
FIGS. 19 and 20 are respectively a plan and an elevation of a sixth embodiment of the present invention.
Figure 20:
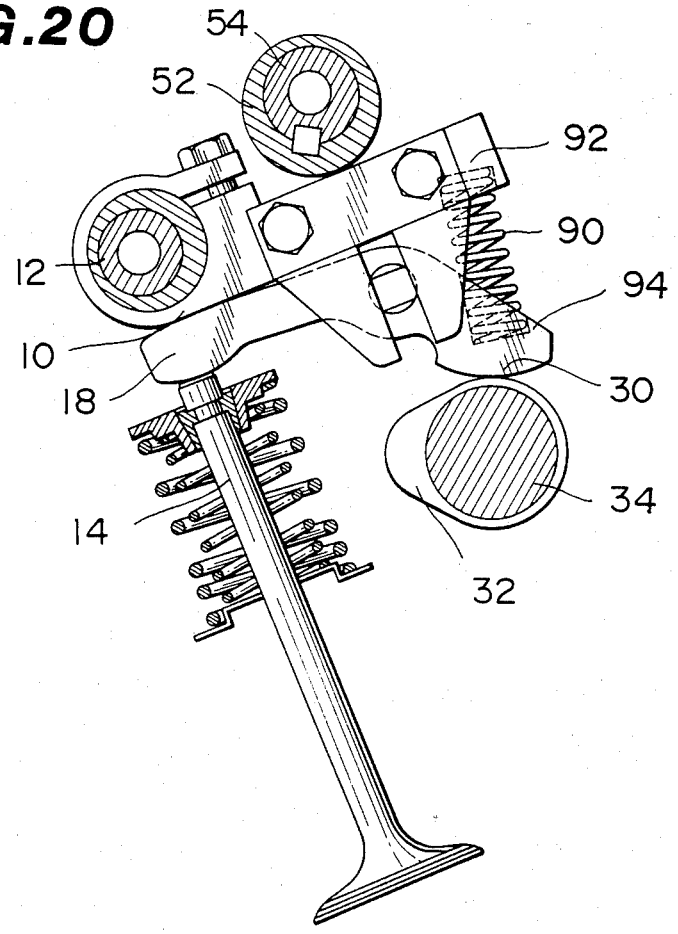

FIGS. 19 and 20 show a sixth embodiment of the present invention. In this arrangement a single coil spring 90 replaces the two springs used in the previously described embodiments. In this embodiment the spring 90 is disposed between a spring retainer 92 provided at the end of the lever and a corresponding retainer 94 formed in the rocker arm adjacent the cam following portion thereof.

Figure 21:
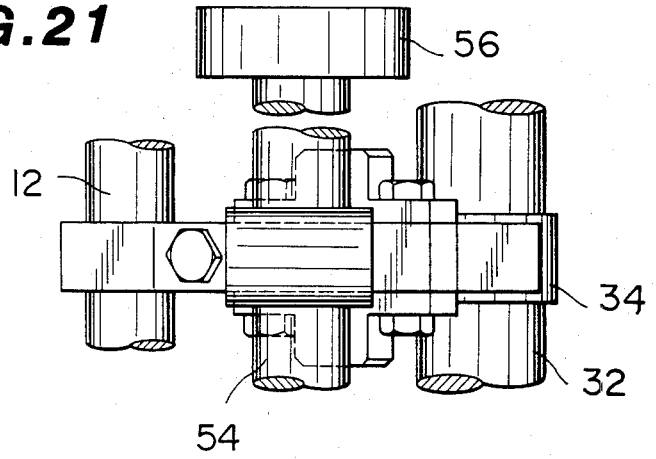
FIGS. 21 and 22 are respectively a plan and an elevation of a seventh embodiment of the present invention.
Figure 22:
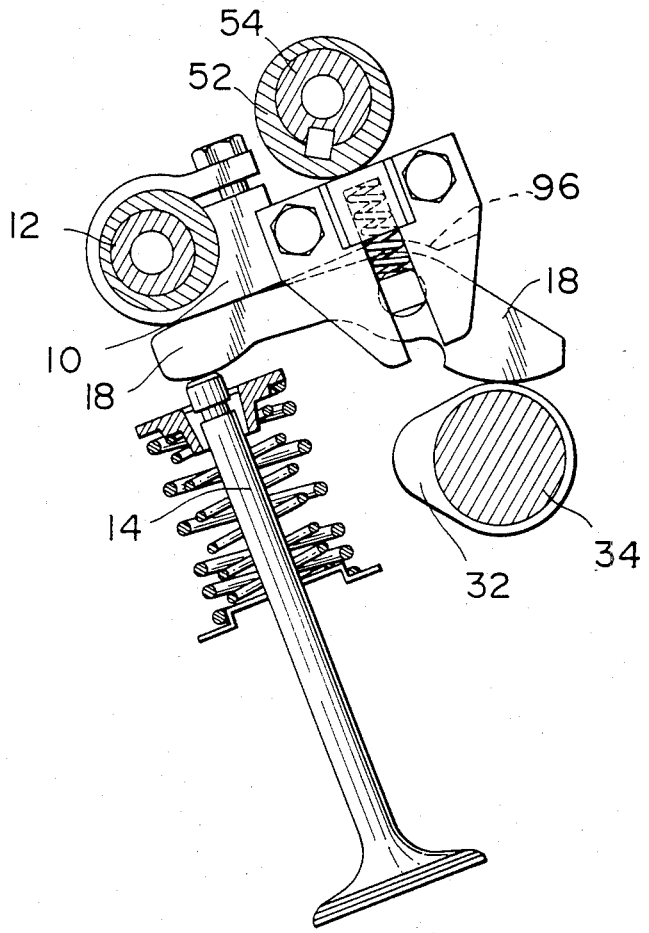

FIGS. 21 and 22 show a seventh embodiment of the present invention. In this arrangement the surface 96 of the lever 10 on which the rocker arm rolls is formed with a concave section which is adapted to engage the apex of the rocker arm 18 just as the valve 28 reaches its maximum lift and when the contact pressure between the lever and the rocker arm maximizes.

The pressure P acting between the surfaces is given by:

$$P \propto \sqrt{Pn\left(\frac{1}{R_1} - \frac{1}{R_2}\right)}$$

wherein:

Pn is the load applied normal to the contacting surfaces, $R_1$ is the radius of curvature of the upper surface of the rocker arm; and $R_2$ is the radius of curvature of the lower surface of the lever.

From this equation it will be clear that the just disclosed arrangement reduces the contact pressure between the surfaces and thus the wear therebetween.

Figure 23:
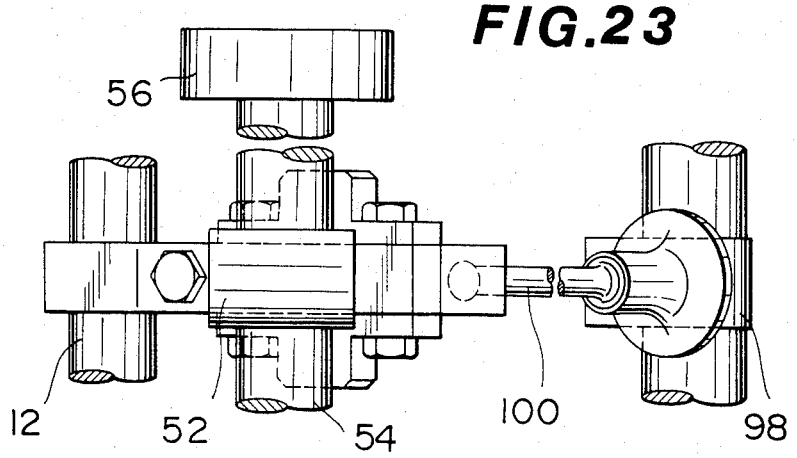
FIGS. 23 and 24 are respectively a plan and an elevation of an eighth embodiment of the present invention.
Figure 24:
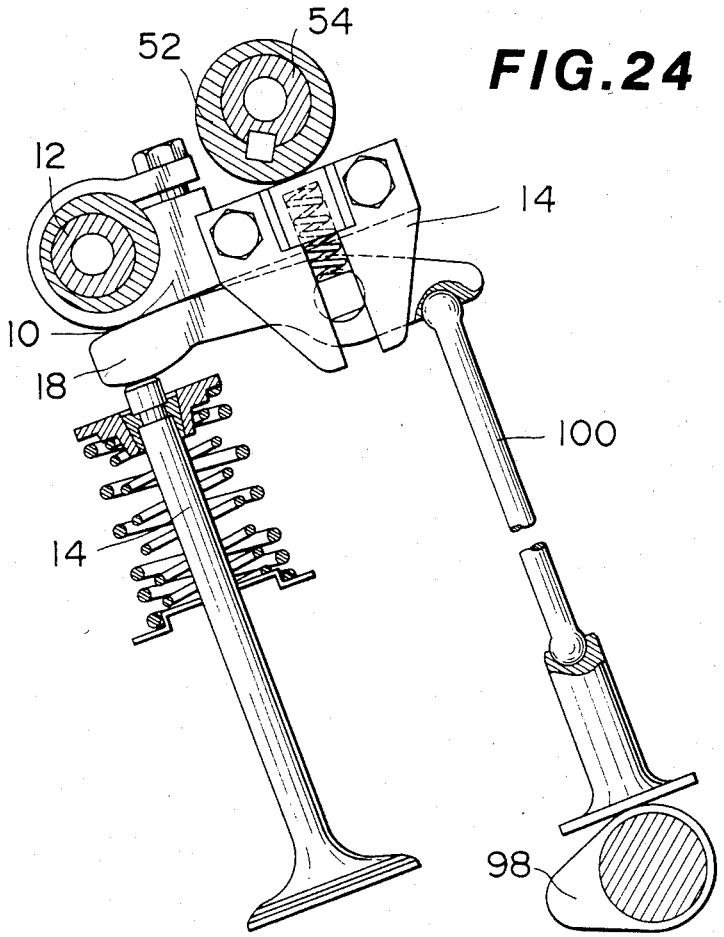

FIGS. 23 and 24 show an eighth embodiment of the present invention. This arrangement is the same as the first embodiment with the exception that the arrangement is adapted to an engine having a side cam 98 and push rod 100.

Figure 25:
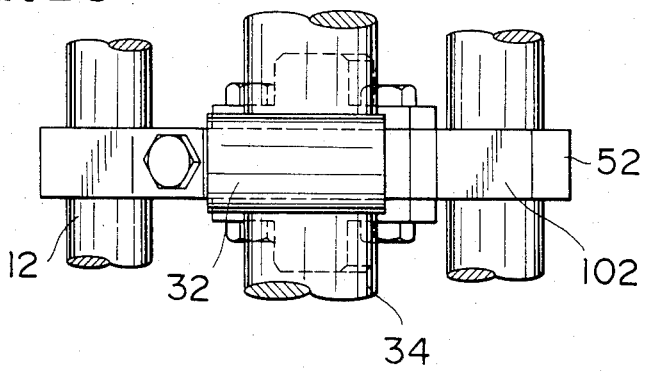
FIGS. 25 and 26 are respectively a plan and an elevation of a ninth embodiment of the present invention.
Figure 26:
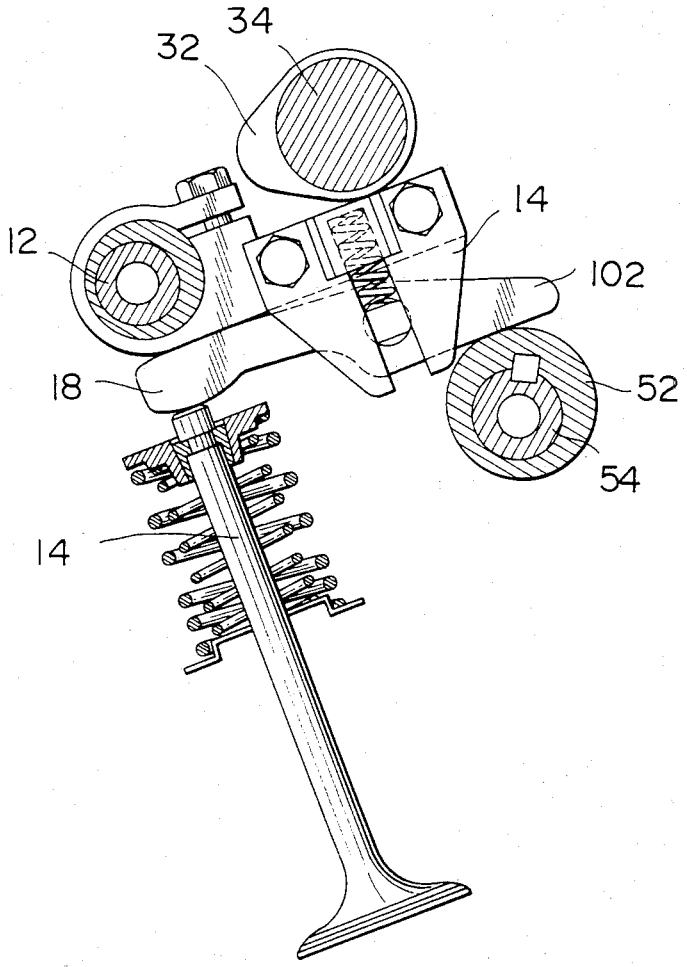

FIGS. 25 and 26 show a ninth embodiment of the present invention. In this arrangement the positions of the cams are reversed so that the cam 32, driven in synchronism with the engine crankshaft, is adapted to engage the upper surface of the lever 10 while the cam which is selectively rotatable is adapted to engage a tang-like extension 102 of the rocker arm, which in this case is less angled than in previous embodiments.

It will be thus appreciated that various arrangements of the above disclosed arrangement are possible thus increasing the design variation of the crowded cylinder head environment.

What is claimed is:

1. A valve train for inducing reciprocative motion in a valve comprising:

a lever pivotally mounted at one end thereof;

a rocker arm engaging said lever to define a fulcrum point therebetween, said rocker arm engaging said valve at a first end thereof;

a mechanism guidingly interconnecting said rocker arm at a point intermediate of the ends thereof with said lever;

first means engaging one of a pair of elements comprising said lever and a second end of said rocker arm for inducing reciprocative motion therein; and second means engaging the other of said pair of elements comprising said lever and said second end of said rocker arm for selectively controlling the angular position thereof with respect to said valve;

wherein said mechanism comprises:

a shaft rotatbly disposed through said rocker arm;

means defining a guide slot in said lever for slidably receiving said rotatable shaft; and spring means for biasing said lever and said rocker arm apart.

2. A valve train as claimed in claim 1 wherein said slot defining means takes the form of a fork which depends from said lever.

3. A valve train as claimed in claim 2, wherein said spring means takes the form of a coil spring having one end disposed in a spring retainer formed in said fork and the other end in engagement with said rotatable shaft.

4. A valve train as claimed in claim 2, further comprising a retainer which interconnects the ends of said fork and closes said slot.

5. A valve train as claimed in claim 1, wherein said lever is mounted on a stationary shaft through an eccentric bush, and wherein said lever includes a clamp for releasably locking said eccentric bush in a selected position with respect to said lever, said bush permitting the adjustment of the clearance defined between the rocker arm and said valve.

6. A valve train as set forth in claim 1, wherein said spring means takes the form of a coil spring interposed between a spring retainer formed in said rocker arm and a spring retainer formed in said lever.

7. A valve train as claimed in claim 1, wherein said spring means is a torsion spring detachably fixed at one end to said lever by a bolt and which engages at its other end said rotatable shaft.

8. A valve train as claimed in claim 1, wherein said slot is curved for reducing relative slip between said rocker arm and said lever.

9. A valve train as claimed in claim 1, further comprising a push rod interposed between said first means and said one of said lever and said second end of said rocker arm.

10. A valve train as claimed in claim 1, wherein said first means is a cam which is continuously rotatable.

11. A valve train as claimed in claim 1, wherein said second means is a cam which is selectively rotatable by an actuator.

12. A valve train as claimed in claim 1, wherein said rocker arm is formed with a curved apex and said lever is formed with a concave section adapted to receive said curved apex in a manner to reduce the surface pressure generated between said rocker arm and said lever.

13. In a valve train for inducing reciprocative motion in a valve:

a lever pivotally mounted at one end thereof;

a rocker arm engaging said lever to define a fulcrum point therebetween, said rocker arm engaging said valve at a first end thereof;

a mechanism guidingly interconnecting said rocker arm at a point intermediate of the ends thereof with said lever;

first means engaging one of a pair of elements comprising said lever and a second end of said rocker arm for inducing reciprocative motion therein; and second means engaging the other of said pair of elements comprising said lever and said second end of said rocker arm for selectively controlling the angular position thereof with respect to said valve.

14. A valve train as claimed in claim 13, wherein said mechanism guidingly interconnecting said rocker arm with said lever comprises means for preventing relative slippage between said rocker arm and said lever.

* * * * *